US006269848B1

(12) United States Patent
Corfitsen

(10) Patent No.: US 6,269,848 B1
(45) Date of Patent: Aug. 7, 2001

(54) DEVICE FOR AUTOMATIC FUELLING OF VEHICLES

(75) Inventor: Sten Corfitsen, Lidingö(SE)

(73) Assignee: Autofill Patent AB, Lidingo (SE)

( * ) Notice: Subject to any disclaimer, the term of this patent is extended or adjusted under 35 U.S.C. 154(b) by 0 days.

(21) Appl. No.: 09/424,446

(22) PCT Filed: May 26, 1998

(86) PCT No.: PCT/SE98/00987

§ 371 Date: Feb. 16, 2000

§ 102(e) Date: Feb. 16, 2000

(87) PCT Pub. No.: WO98/54083

PCT Pub. Date: Dec. 3, 1998

(30) Foreign Application Priority Data

May 28, 1997 (SE) ..... 9702010

(51) Int. Cl.[7] ..... B67D 5/08

(52) U.S. Cl. ..... 141/94; 141/98; 141/231

(58) Field of Search ..... 141/94, 98, 231, 141/232; 901/6, 16, 46

(56) References Cited

U.S. PATENT DOCUMENTS

| | | | | |
|---|---|---|---|---|
| 3,642,036 | | 2/1972 | Ginsburgh et al. | 141/94 |
| 4,708,175 | | 11/1987 | Janashak et al. | 141/1 |
| 5,238,034 | | 8/1993 | Corfitsen | 141/94 |
| 5,383,500 | * | 1/1995 | Dwars et al. | 141/98 |
| 5,609,190 | * | 3/1997 | Anderson et al. | 141/94 |
| 5,671,786 | | 9/1997 | Corfitsen | 141/94 |

FOREIGN PATENT DOCUMENTS

| | | |
|---|---|---|
| WO 91/17111 | 11/1991 | (WO) . |
| WO 92/01952 | 2/1992 | (WO) . |
| WO 94/06031 | 3/1994 | (WO) . |
| WO 96/39351 | 3/1994 | (WO) . |

* cited by examiner

*Primary Examiner*—J. Casimer Jacyna
(74) *Attorney, Agent, or Firm*—Alfred J. Mangels

(57) ABSTRACT

Automatic refuelling of vehicles, primarily cars, is effected by a fuelling robot. An optical sensor is disposed adjacent the fuelling robot and is adapted to detect optically the position of the fuel-tank flap of a vehicle parked for fuelling purposes, relative to the rest position of the robot head. The sensor is adapted to sense a code that is optically readable and that is carried by the vehicle. A computer is adapted to guide a robot-carried opening device into abutment with the fuel-tank flap, to open the flap, to effect docking of a fuelling nozzle in accordance with a movement plan, and also to carry out those movements in a reverse order and thereby close the fuel-tank flap when fuelling has been completed.

10 Claims, 3 Drawing Sheets

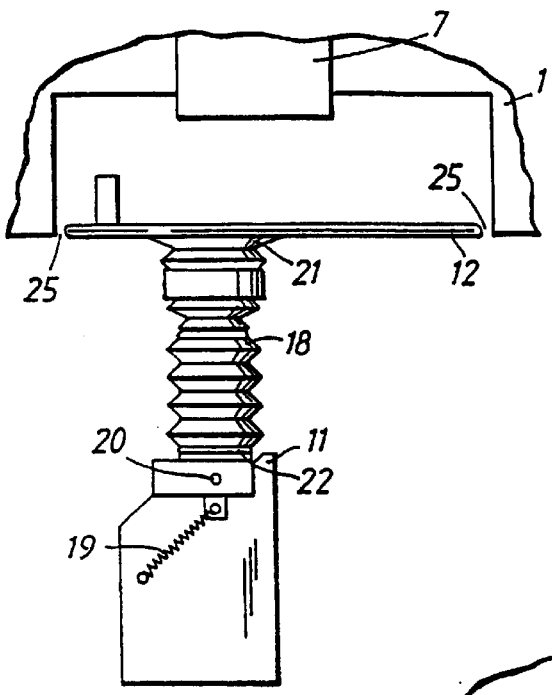
Fig. 6
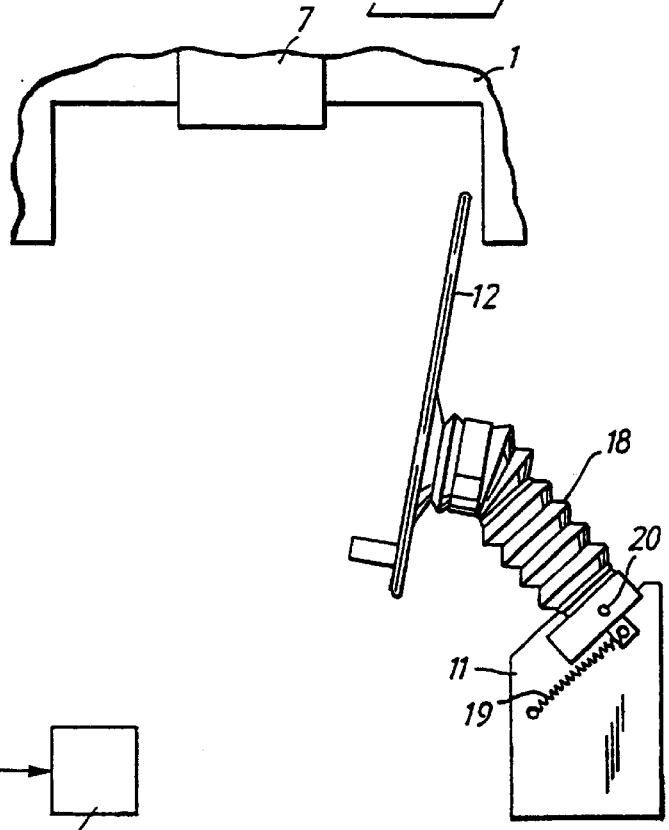
Fig. 7
Fig. 8
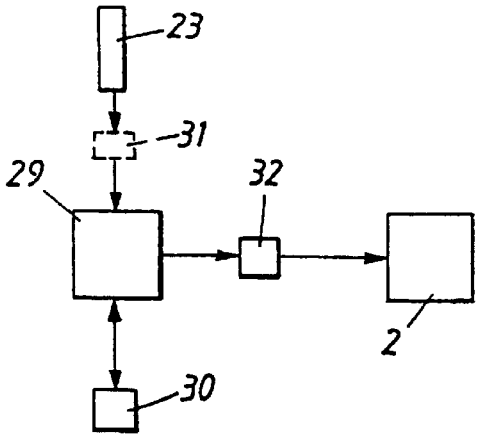

DEVICE FOR AUTOMATIC FUELLING OF VEHICLES

BACKGROUND OF THE INVENTION

1. Field of the Invention

The present invention relates to apparatus for automatically refuelling vehicles, primarily cars.

2. Description of the Related Art

Apparatus by means of which cars can be fuelled automatically are described in Swedish Patent Specification No. 8901674-5.

The apparatus according to this prior patent specification comprises a robot which includes a fuelling nozzle or corresponding device, and which when the vehicle is located in a predetermined position in relation to the robot functions to move the refuelling nozzle automatically from a rest position to a vehicle fuelling position in response to is sensing and control means. The fuelling nozzle includes a rigid first tube which is adapted to be moved by the robot towards an adapter provided with a hole associated with the vehicle fuelling location. A flexible, second tube is arranged for movement within the first, rigid tube from a first end position in which the outer free end of the second tube is located within the first tube, to a second position in which the second tube projects out from the first tube. A tube connection is provided between said hole and the vehicle fuel-tank pipe. The robot is constructed to move the free end of the second tube axially out of the first tube and down into said tube connection, or down into the vehicle fuel-tank pipe, and pump fuel through the second tube and into the fuel tank.

Swedish Patent Specification No. 9202550-1 describes a method of opening and closing the fuelling-tank flap of a vehicle.

According to this latter patent specification, a vehicle-mounted transponder which co-acts with a transceiver unit fitted to the robot head contains information relating to the particular pattern of movement, or movement plan, that is to be carried out by the robot head in relation to the vehicle to be fuelled at that time. The transceiver unit also co-acts with the transponder to initially position the robot head in relation to the vehicle.

It is desired to simplify this positioning process and also the flap opening process. It is also desired to obviate the use of microwave equipment.

These objects are fulfilled by the present invention.

SUMMARY OF THE INVENTION

The present invention thus relates to apparatus for automatically refuelling vehicles, primarily cars. The apparatus comprises a robot which includes a robot head that is movable relative to the robot so as to enable the robot head to be brought to a predetermined position in relation to the vehicle fuel-tank pipe from a rest position by means of a positioning system. The robot head includes an outer tube, and an inner tube which is housed within said outer tube and movable axially out of the outer tube. The outer tube is intended to be docked with an adapter attached to the upper orifice of the fuel-tank pipe. Subsequent to docking said outer tube, the free forward end of the inner tube is intended to be projected to a lower position in the fuel-tank pipe, whereafter fuel is delivered through the inner tube. The robot head carries a flap opening device which functions to open a fuel-tank flap in response to movements of the robot head, wherein the robot head movements are effected in accordance with a movement plan or pattern that has been fed into a computer connected to the robot in the form of a code. The computer includes a memory in which a specific movement plan is stored for each code, and the computer is designed to steer the robot head in carrying out the movement plan belonging to the code received. An optical sensor means is arranged adjacent the robot and optically detects the position of the fuel-tank flap of a vehicle parked for refuelling, relative to the rest position of the robot head. The sensor means is adapted to read said code, which is optically readable and is carried by the vehicle. The computer is adapted to guide the opening device on said robot into abutment with the fuel-tank flap, to cause said device to open said flap, to perform docking in accordance with said movement plan, and to carry out those movements in a reverse order and therewith close the fuel-tank flap when refuelling is completed.

BRIEF DESCRIPTION OF THE DRAWINGS

The invention will now be described in more detail with reference to an exemplifying embodiment thereof and also with reference to the accompanying drawings, in which

FIG. 6 illustrates schematically a closed fuel-tank flap and a flap opening device;

FIG. 7 illustrates schematically a fuel-tank flap opened by means of the opening device; and FIG. 8 is a block schematic of the control elements of one form of the invention.

DESCRIPTION OF THE PREFERRED EMBODIMENTS

Figure 1:
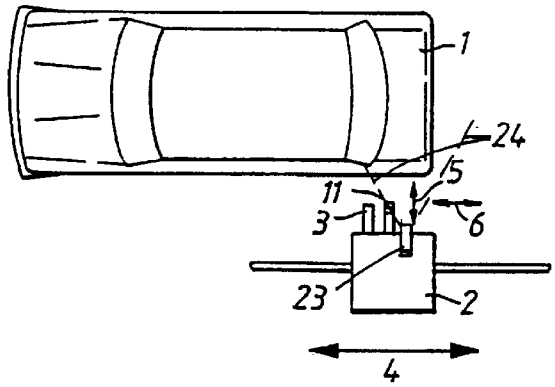
FIG. 1 illustrates a vehicle and a robot of the kind in question viewed from above.

FIG. 1 is a schematic illustration of a vehicle automatic refuelling station, primarily for cars 1, which includes a robot 2 that has a robot head 3 which is movable relative to the robot so as to be brought to a predetermined position relative to the fuel-tank pipe of the vehicle. The robot is movable in the directions indicated by the double-headed arrow 4. The robot head 3 is movable in the direction indicated by the double headed arrows 5 and 6 and also in a direction perpendicular to the plane of the paper.

Figure 3:
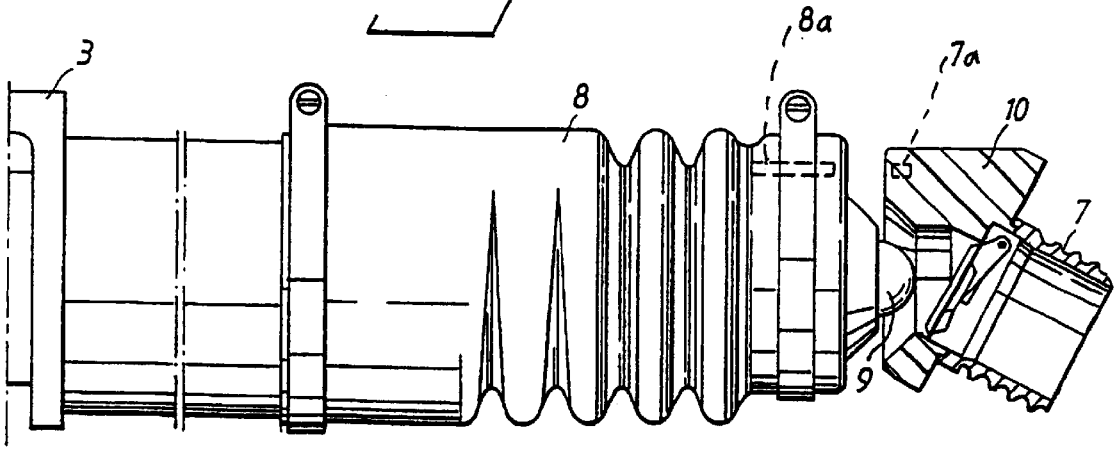
FIG. 3 illustrates the front part of a robot head and an adapter attached to the upper orifice of a vehicle fuel-tank pipe.

The front part of the robot head is shown in larger scale in FIG. 3. The robot head 3 includes an outer tube 8 and an inner tube 9 which is housed within the outer tube and which can be moved axially within said outer tube and outwardly therefrom. The outer tube 8 is intended to be docked with an adapter 10 attached to the upper orifice of the fuel-tank pipe 7. Subsequent to docking, the free, front end of the inner tube 9 is moved to a position further down in the fuel-tank pipe, whereafter fuel is delivered to the fuel-tank through the inner tube 9.

According to said patent, the robot head 3 is positioned relative to the fuel-tank pipe 7 of the vehicle by means of a positioning system that includes a transceiver unit 8*a* adjacent the robot head, which is preferably designed to operate at microwave frequencies, and a passive transponder 7*a* is mounted on the vehicle at a predetermined position in relation to the fuel-tank flap. The positioning system used is preferably the positioning system described in Swedish Patent Specification No. 8403564-1. By passive transponder is meant a transponder that receives a signal from the transceiver and re-transmits this signal without adding any further energy to the signal, i.e. reflects the signal. According to the patent, the transponder includes information relating to a predetermined robot movement plan for opening the fuel-tank flap.

The robot head 3 carries a fuel-tank flap opening device 11, which is shown in larger scale in FIG. 6. The opening device 11 is constructed to open the fuel-tank flap 12 of a vehicle 1 in response to movements of the robot head.

Opening device 11 includes a resilient, bellows-like element 18 which is mounted for pivotal movement on a shaft 20 against a spring force exerted by a spring 19, said pivot shaft being located at right angles to the plane in which the robot head moves during an opening operation. The pivot shaft 20 will thus normally extend vertically. In its rest state, the bellows-like element 18 extends parallel with the outer tube 8 of the robot head. The forward, free end 21 of the bellows-like element 18 is open, whereas its other end 22 is connected to a suitable known source of sub-atmospheric pressure (not shown).

FIG. 6 shows the opening device in a position to which it has been brought by the robot head and in which the front end 21 of said element abuts a vehicle fuel-tank flap or cover plate 12, i.e. a position at which the opening operation shall commence.

An opening and docking sequence takes place in the following way: The vehicle is placed in a predetermined position in relation to the robot, although reasonable deviations from this predetermined position are allowed. The robot is then positioned relative to the fuel-tank flap. Subsequent thereto, the robot computer guides the robot head for movement in accordance with a predetermined plan, wherein the opening device is moved to the position shown in FIG. 6, by means of the robot head. A sub-atmospheric pressure is then generated in the bellows-like element 18, which is thereby firmly drawn against the fuel-tank flap.

The robot head then continues to move in accordance with the movement plan illustrated in FIG. 7 thereby opening the fuel-tank flap.

Upon completion of this movement, the robot head docks the outer tube 8 with the adapter and the inner tube 9 is then inserted down into the fuel-tank pipe. Fuel is then delivered to the fuel-tank pipe through the inner tube.

When the vehicle has been refuelled, the aforedescribed movements are carried out in the reverse order, thereby closing the fuel-tank flap and returning the robot to its original starting position.

FIGS. 6 and 7 show an example in which the fuel-tank flap 12 is pivoted about a vertical axis at one edge of the flap. The movement plan can, of cause, be installed for opening flaps that are pivotal about a vertical axis and flaps that are pivotal about a horizontal axis or about an axis of some other orientation.

The features described above are also found described in the aforesaid Swedish patent specification.

One problem encountered resides in arranging microwave equipment in connection with the robot head and using the transponder to position the robot in its starting position. Another problem is that the transponder must be positioned accurately in a predetermined location on the vehicle.

The present invention solves these problems.

According to the present invention, an optical sensor means 23 is provided in connection with the robot. The sensor means is adapted to detect optically the position of the fuel-tank flap of a vehicle parked for refuelling relative to a robot head rest position.

The sensor means 23 is adapted to sense the code for the robot movement plan, said code being optically readable and provided on the vehicle.

The computer is programmed to guide the robot-carried opening device 11 into abutment with the fuel-tank flap 12 with the aid of the detected position of said flap. The robot is adapted to open the flap and to effect said docking in accordance with the movement plan, and to carry out the movements in the reverse order and thus close the fuel-tank flap when fuelling of the vehicle is completed.

Figure 2:
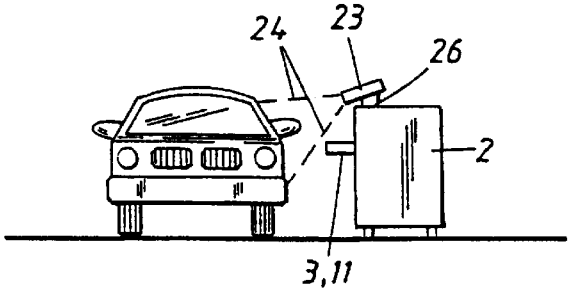
FIG. 2 is a front view of a vehicle positioned adjacent a robot.

The optical sensor means is suitably mounted on the upper part of the robot and inclined downwards, as shown in FIG. 2. The broken lines 24 in FIGS. 1 and 2 define the approximate extent of the area sensed or scanned by the sensor means.

According to one preferred embodiment, the optical sensor means is a suitable, known scanning laser, preferably an IR laser, and a signal processing circuit adapted to detect the fuel-tank flap and its position relative to the rest position of the robot head.

Several different kinds of scanning lasers suitable for use to this end are commercially available. Although the scanning used will preferably be a low-power IR laser, it will be understood that other lasers may alternatively be used. There may be used a scanning laser that deflects the laser beam in mutually parallel lines in both a horizontal and vertical direction, such as a laser having a wobbling mirror for deflecting the laser beam.

Such a laser can be used to detect reflected laser light and/or to measure distances.

In the illustrated embodiment, the laser is adapted conveniently to first scan a predetermined area within which the fuel-tank flap of a correctly parked car is located, and thereby detect the fuel-tank flap by detecting reflected laser light. It is well known to detect objects and shapes with the aid of scanning lasers. Because of the channel-shaped recess or gap 25 that runs between the fuel-tank flap and the surrounding chassis, the fuel-tank flap can be readily identified by means of the signal processing circuit. This circuit is programmed to look for a rectangular or round shape, formed by the channel-shaped recess.

The predetermined area may encompass part of one side of a vehicle or the whole of one side thereof. The robot may be arranged to move in the directions 4 along the whole of one side of a vehicle.

Subsequent to the laser having identified the fuel-tank flap, the signal processing circuit functions to determine the angles defined by the laser beam against the fuel-tank flap in the horizontal plane and the vertical plane. The laser then functions to measure the distance to some point on the flap. Knowledge of the aforesaid angles and said distance reveals the position of the fuel-tank flap relative to the robot head. This calculation is carried out suitably by the robot computer or by a computer that includes the signal processing circuit.

According to one alternative embodiment, the optical sensor means includes an appropriate, known device for detecting visible light, such as a lens and a CCD element, i.e. video equipment, and a signal processing circuit adapted to detect, by image processing, the fuel-tank flap and its position relative to the rest position of the robot head. It is well known to detect objects by image processing. In this respect, the fuel-tank flap is detected in a manner corresponding to that described above, whereby the channel-like recess or gap 25 extending around the flap is detected by virtue of its shape. The aforesaid angles are then determined by the signal processing circuit.

The distance to the fuel-tank flap is determined by the video equipment focusing on the flap and thereby sensing the set focal distance. The video equipment may also be movable around a suspension point 26 (see FIG. 2), so as to enable the equipment to be brought into alignment with the fuel-tank flap and therewith determine the distance to said flap with the aid of a known autofocus system of the kind used on video cameras. The video equipment may also be arranged to zoom in the fuel-tank flap and therewith enhance the accuracy of determining the distance by means of said autofocus system.

According to one preferred embodiment of the invention, the sensor means and the computer are designed to detect the shape of the fuel-tank flap. In this regard, the computer is also programmed to calculate the centroid or center of the surface of gravity of the flap and to calculate the position of said point relative to the rest position of the robot head. This results in accurate determination of the position of the flap relative to the rest position of the robot.

Figure 4:
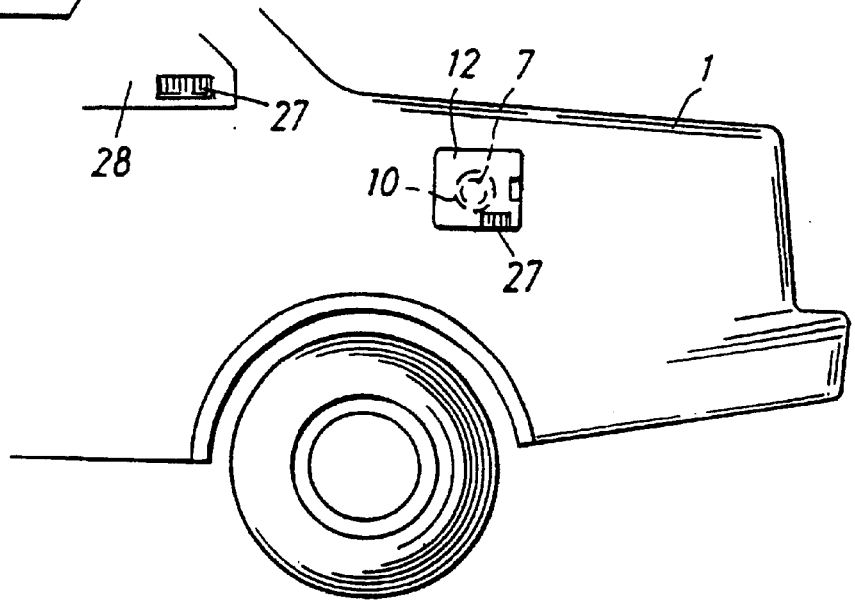
FIGS. 4 and 5 illustrate the rear part of one side of a vehicle, showing the fuel-tank flap.
Figure 5:
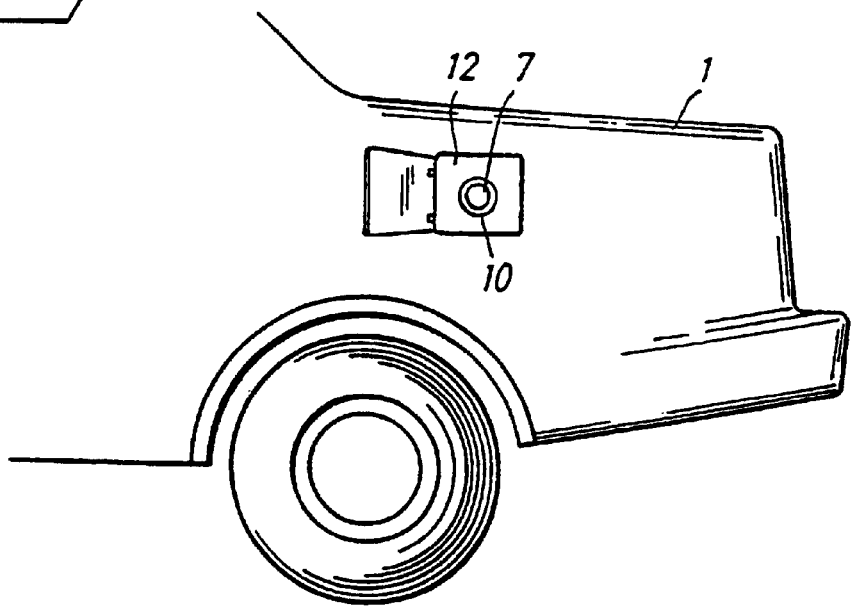

According to one highly preferred embodiment of the invention, the code containing information relating to the robot movement plan is comprised of a well known bar code. The sensor means 23 is designed to read the bar code and store said code in the robot computer. As shown in FIG. 4, the bar code may be affixed to a slip 27 placed on the inside of the rear window 28 of the vehicle or on the outside of the flap 12.

Alternatively, the code may be engraved on the vehicle chassis or on the outside of the fuel-tank flap or configured with other forms of indentations (not shown), these indentations or surface irregularities being detected by means of the sensor means.

Although it is possible to store a movement plan for each vehicle per se, it is probable that from 15 to 25 different movement plans will be sufficient, since a given movement plan for a given vehicle can be used for other vehicles. This means that only 15 to 25 different bar codes need be provided for essentially all vehicles that can be served by the inventive system.

FIG. 8 is a block schematic illustrating the invention, where the robot computer is referenced 29. The computer memory is referenced 30. The sensor means 23 sends to the computer signals that are processed in a signal processing circuit referenced 31. This circuit may be included in the computer or may be completely or partially separate therefrom, as indicated in broken lines, and connected to the computer. The computer actuates operating circuits 32 on the basis of these calculations, these circuits actuating the robot 2 in turn.

It will be apparent from the aforegoing that positioning of the robot opening of the fuel-tank flap and docking are easier to carry out, since only one sensor means is required and since this sensor is mounted separate from the robot head. Furthermore, it is only necessary to place the aforesaid code on the vehicle so that it can be read by the sensing equipment. Neither is it necessary to place the code with great precision relative to a point on the vehicle. Furthermore, the invention obviates the need of using microwave equipment.

Although the invention has been described above with reference to a number of exemplifying embodiments thereof, it will be understood by the person skilled in this art that modifications can be made.

The present invention is therefore not restricted to these embodiments, since modifications and variations can be made within the scope of the following claims.

What is claimed is:

1. Apparatus for automatically refuelling vehicles, primarily cars, said apparatus comprising: a robot which includes a robot head that is movable relative to said robot to enable the robot head to be brought from a rest position to a predetermined position relative to a vehicle fuel-tank pipe, wherein the robot head includes an outer tube and an inner tube housed within said outer tube and movable axially out of said outer tube, wherein the outer tube is adapted to be docked with an adapter attached to an inlet orifice of the fuel-tank pipe so that subsequent to docking of said outer tube, a free forward end of the inner tube is extended into the fuel-tank pipe to deliver fuel through the inner tube and into the fuel-tank pipe, the robot head including a fuel-tank flap opening device to open a fuel-tank pipe cover flap in response to movements of the robot head, an optically readable movement plan code carried on the vehicle, a robot head positioning system including a computer having a memory for storing a plurality of movement plans corresponding with respective movement plan codes, wherein the computer is programmed to control the robot head to carry out a movement plan corresponding with an optically-read movement plan code after receiving said code, the positioning system including an optical sensor disposed adjacent the robot for detecting optically the position of the fuel-tank flap of a vehicle parked for fuelling purposes, relative to the rest position of the robot head, wherein the optical sensor senses said movement plan code, and wherein the computer is adapted to guide the fuel-tank flap opening device into abutment with the fuel-tank flap and to open said flap and effect said docking in accordance with said movement plan, and also to carry out said movements in reverse order and thereby close the fuel-tank flap when fuelling has been completed.

2. Apparatus according to claim 1, wherein the optical sensor includes a laser, and the positioning system includes a signal processing circuit responsive to an output signal from the optical sensor to detect the fuel-tank flap position relative to the rest position of the robot head.

3. Apparatus according to claim 2, wherein the laser is an IR laser.

4. Apparatus according to claim 1, wherein the optical sensor includes a visible light detecting device, and the positioning system includes a signal processing circuit responsive to an output signal from the optical sensor to detect the fuel-tank flap position relative to the rest position of the robot head.

5. Apparatus according to claim 4, wherein the visible light detecting device includes a lens and a CCD element.

6. Apparatus according to claim 1, wherein said movement plan code is a bar code.

7. Apparatus according to claim 6, wherein said bar code is disposed on a support surface attached to the inside of a vehicle panel.

8. Apparatus according to claim 6, wherein said bar code is disposed on a window of the vehicle.

9. Apparatus according to claim 6, wherein said bar code is disposed on the fuel-tank flap.

10. Apparatus according to claim 1, wherein the optical sensor detects the shape of the fuel-tank flap; and the computer calculates the centroid of the fuel-tank flap surface and the position of the centroid relative to the rest position of the robot head.

* * * * *